United States Patent [19]

Griesemer, Sr.

[11] 4,335,926

[45] Jun. 22, 1982

[54] METHOD FOR VAPORIZING GETTER MATERIAL IN A SUCCESSION OF CATHODE-RAY TUBES

[75] Inventor: Douglas E. Griesemer, Sr., Lancaster, Pa.

[73] Assignee: RCA Corporation, New York, N.Y.

[21] Appl. No.: 134,216

[22] Filed: Mar. 26, 1980

[51] Int. Cl.[3] ..... H01J 9/39

[52] U.S. Cl. ..... 316/3; 316/25; 316/30

[58] Field of Search ..... 316/17, 18, 19, 25, 316/30, 3

[56] References Cited

U.S. PATENT DOCUMENTS

| | | | |
|---|---|---|---|
| 2,532,315 | 12/1950 | Johnson et al. | 316/30 |
| 2,843,445 | 7/1958 | Coltrin | 316/30 |
| 2,881,298 | 4/1959 | Allgaier | 316/30 |
| 3,115,732 | 12/1973 | Stewart | 53/88 |
| 3,508,105 | 4/1970 | Pappadis | 313/178 |
| 3,558,961 | 1/1971 | Palsha | 313/174 |
| 3,558,962 | 1/1971 | Reash | 313/180 |
| 3,906,282 | 9/1975 | Krackhardt et al. | 313/481 |
| 3,922,049 | 11/1975 | Sawicki | 316/19 |
| 3,964,812 | 6/1976 | Turnbull | 316/25 |

*Primary Examiner*—John McQuade

*Attorney, Agent, or Firm*—E. M. Whitacre; G. H. Bruestle; L. Greenspan

[57] ABSTRACT

In a method for flashing the getter in a succession of cathode-ray tubes of different sizes and/or shapes, where the getter container is adjacent the inner surface of the tube envelope, the step of permanently fixing the getter container of each tube of the succession in such position that the container centerline intersects the outer surface of the envelope at substantially the same distance from the longitudinal axis as each of the other tubes of the succession.

8 Claims, 5 Drawing Figures

METHOD FOR VAPORIZING GETTER MATERIAL IN A SUCCESSION OF CATHODE-RAY TUBES

BACKGROUND OF THE INVENTION

This invention relates to a novel method for vaporizing getter material inside a succession of cathode-ray tubes and particularly, but not exclusively, to a novel method for flashing the getter material from getter containers in each of a succession of color television tubes, which tubes may be of different sizes and/or shapes and may be randomly intermixed.

In one popular design of a color television picture tube, which is a type of cathode-ray tube, a ring-shaped getter container having getter material therein is held against or close to the inner surface of that part of the envelope, called the funnel, which is conical in shape. After the envelope is evacuated of gases and sealed, an induction coil is positioned against or close to the outer surface of the envelope opposite the getter container and is then energized with a high-frequency current. The magnetic field generated by the energized coil induces currents in the getter container causing the temperature of the getter container and the getter material therein to rise rapidly until getter material, which is usually barium metal, vaporizes or "flashes" and deposits as a getter film on internal surfaces of the tube. A purpose of the getter film is to absorb (a) residual gas left in the envelope after evacuation and (b) adsorbed gas that is later evolved from internal surfaces during the operating life of the tube. The life of the tube is determined principally by the ability of the getter film to continue to absorb gas and to maintain a low gas pressure in the envelope.

In order to vaporize the maximum amount of getter material from the container and to realize a desired distribution of deposited getter material in the tube, it is necessary to position the induction coil properly with respect to the getter container so as to produce optimum magnetic coupling between them. This is not easily done. Although the envelope is usually constituted of a transparent glass, the getter container cannot be seen (optically) from outside the tube because the inner surface of the envelope opposite the getter container is coated with an opaque internal coating.

Heretofore, it was the common procedure to make a dummy tube without any opaque internal coating present, and then to determine where the induction coil should be located on tubes of that design in order to flash the getter material from the getter container. For each tube design; that is, for each shape and/or size, the getter container was located at its own unique position with respect to the longitudinal axis of the tube both measured normal to the tube axis (radial distance) and up from some plane normal to the tube axis (axial distance), even though the containers were in a particular longitudinal plane that intersects that longitudinal tube axis. Thus, during factory production, it was necessary from a practical standpoint to process a batch of tubes of the same design, then to reset the induction-coil positioner for the succeeding batch of tubes of a different design. Or, if a randomly intermixed succession of tubes of different designs was processed, it was necessary to recognize the design of each particular tube as it presents itself, to remember its getter position, and to position the induction coil opposite that position. Or, if randomly intermixed, the tubes were sorted by design and then processed in different machines, each of which was set up for a particular tube design.

SUMMARY OF THE INVENTION

In the novel method, as in prior methods, the getter container of each tube in a succession of cathode-ray tubes is held against or close to the inner surface of the conical portion of the tube envelope, which may carry an opaque coating thereon. Also, an induction coil is positioned adjacent to the outer surface of the envelope opposite the container and then is energized to heat the container by induction. In the novel method, unlike prior methods, in each and every tube in the succession of tubes, the getter container is permanently fixed in such a position that the centerline of the container intersects the outer surface of the envelope at substantially the same radial distance from the longitudinal tube axis (measured normal to the tube axis) and in substantially the same longitudinal plane intersecting the tube axis as each of the other tubes in said succession. With the getter containers of each tube so positioned, the induction coil may be properly positioned opposite the getter container of each tube irrespective of its tube design. This may be achieved by placing each tube in the succession in a holder which positions the longitudinal axis and the rotational orientation of the tube. Then, the induction coil is moved to a position such that the centerline of the coil is substantially coincident with the centerline of the getter container. Thus, the centerline of the induction coil intersects the outer surface of the envelope at about the same point as does the container centerline for each tube. The induction coil may be moved directly or in steps to that position. In a preferred form of the novel method, the coil is moved radially (normal to the tube axis) toward the tube axis, and then the coil is moved axially parallel to the tube axis until the coil housing contacts the envelope. At this contact, the tilt of the induction coil centerline is conformed to the tilt of the getter container centerline so that these two centerlines are substantially coincident.

The novel method avoids most of the variability in the positioning of the induction coil relative to the getter container that is experienced with prior getter-vaporizing methods. Instead, both the displacement and the rotational orientation of the getter container with respect to the tube centerline are the same for all tubes regardless of the design of the tube. A simple mechanism can provide translational movements with respect to the tube axis to properly locate the induction coil. The induction coil may be energized when it is positioned in this manner. With better positioning of the coil with respect to the container, a higher yield of getter material can be realized, a preferred distribution of getter material can be realized, smaller induction coils can be used, and lesser amounts of electric power need be used. Also, the cost of getter flashing is reduced through the universal nature of the novel method since the method may be practiced on a succession of tubes of different randomly-intermixed sizes and shapes.

DESCRIPTION OF THE PREFERRED EMBODIMENT

Getters and their use in cathode-ray tubes are well known and need not be described in detail here since they have been described previously for example, in U.S. Pat. Nos. 3,508,105 issued Apr. 21, 1970 to N. P. Pappadis, 3,558,962 issued Jan. 26, 1971 to C. W. Reash, 3,964,812 issued June 22, 1976 to J. C. Turnbull and 3,906,282 issued Sept. 6, 1977 to E. M. Krackenhardt et al.

Figure 1:
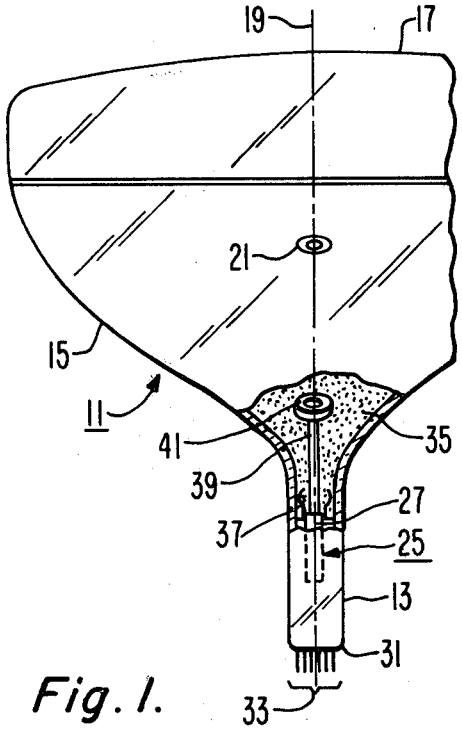
FIGS. 1 and 2 are front and side elevational views, partially broken away, of a cathode-ray tube, having the getter container in position for induction heating prior to vaporizing getter material therein.
Figure 2:
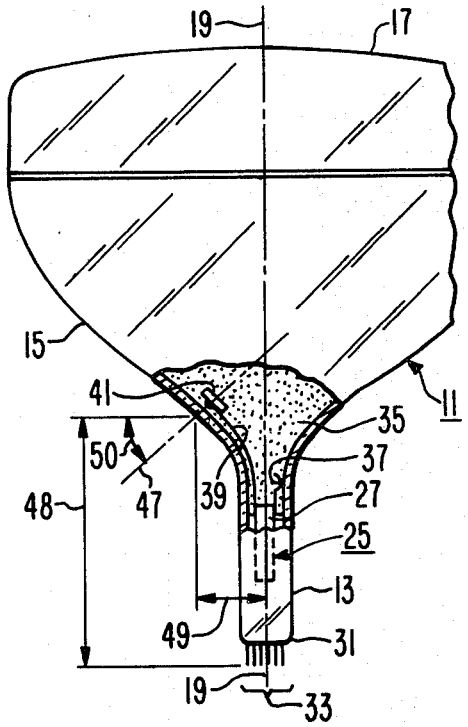
Figure 3:
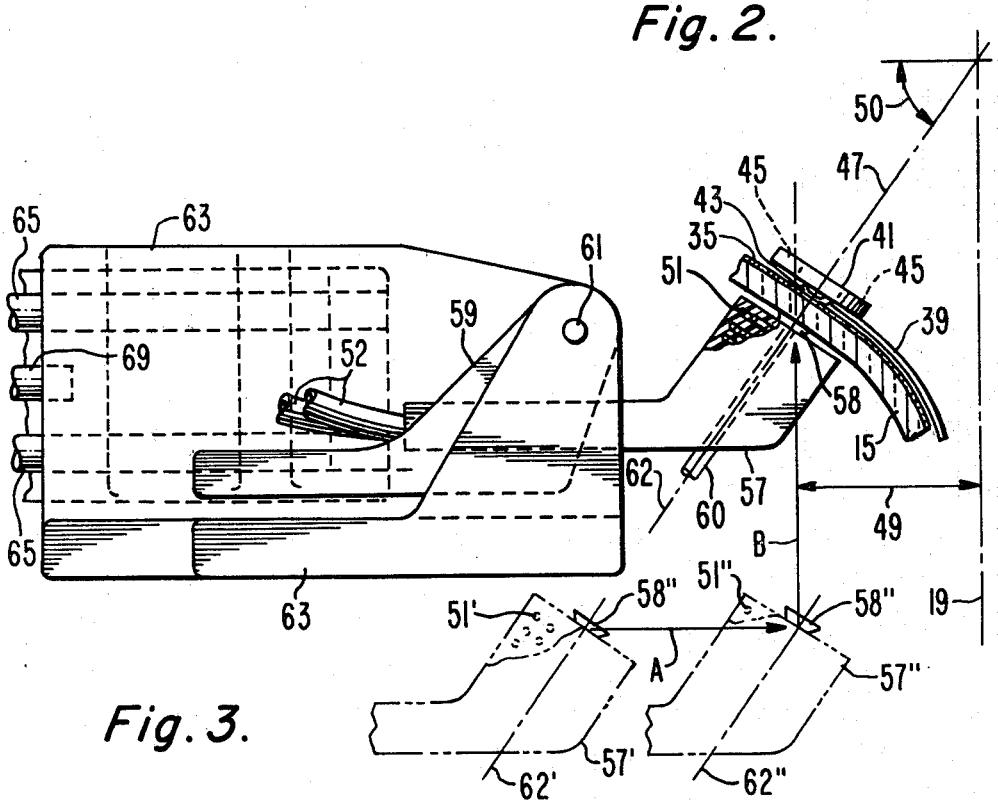
FIG. 3 is a sectional view of an enlarged fragment of the cathode-ray tube of FIG. 1 showing the getter container and an induction coil in relative positions for flashing the getter during a preferred embodiment of the novel method.

FIGS. 1, 2 and 3 show so much of a color television picture tube, which is a type of cathode-ray tube, as is necessary for understanding the novel method. The tube comprises an evacuated envelope 11 including a cylindrical neck 13 extending from the small end of a conical funnel 15. The large end of the funnel 15 is closed by a rectangular faceplate panel 17. A tricolor mosaic screen (not shown) is supported on the inner surface of the panel 17. A shadow mask (not shown) is supported within the envelope 11 close to the screen to achieve color selection. The envelope has a longitudinal tube axis 19 which passes through the panel 17, the funnel 15 and the neck 13. The tube has a plane of major axes parallel to the plane of FIG. 1 and a plane of minor axes parallel to the plane of FIG. 2, both of which pass through the longitudinal axis 19 of the tube. An anode button 21 intersected by the plane of minor axes provides an electrical connection through the wall of the funnel 15.

An electron-gun mount assembly 25 comprising an array of three similar electron guns is mounted in the neck 13. The mount assembly 25 includes a shield cup 27, which is that element of the mount assembly closest to the panel 17. The distal end of the neck 13 is closed by a stem 31 having terminal pins or leads 33 therethrough on which the mount assembly 25 is supported and through which electrical connections are made to various elements of the mount assembly 25.

An opaque, conductive funnel coating 35 comprising graphite, iron oxide and a silicate binder on the inner surface of the funnel 15 is electrically connected to the high-voltage terminal or anode button 19 in the funnel 15. Three bulb spacers 37 are welded to and connect the shield cup 27 with the funnel coating 35. The bulb spacers 37, which are preferably made of spring steel, also center and position the distal end of the mount assembly 25 with the longitudinal axis 19 of the tube.

A getter assembly comprises an elongated spring 39, which is attached at its proximal end to the cup 27 of the mount assembly 25 and extends in cantilever fashion into the funnel 15. A ring-shaped metal getter container 41 about 2.54 cm (1 inch) in diameter is attached to the distal end of the spring 39, and a sled including two curved runners 43 is attached to the bottom of the container 41. The container 41 has a U-shaped channel 45 containing getter material with a closed base facing the inner wall of the funnel 15. The spring 39 is a ribbon of metal which urges the base of the container 41 outwardly toward the funnel wall with the runners 43 contacting the coating 35. The length of the spring 39 permits the container 41 to be positioned well within the funnel 15, where the getter material can be flashed (vaporized) from the container 41 to provide optimum coverage, and where the spring 39 and container 41 will be out of the paths of the electron beams issuing from the mount assembly 25 and not interfere with the operation of the tube.

The centerline 47 of the channel 45, and therefore the centerline of the container 41, intersects the outer surface of the funnel 15 at a radial distance 49 of 5.08 cm (2.00 inches) from and normal to the longitudinal tube axis 19 in the minor-axis plane of the tube 11 (FIGS. 2 and 3). This distance can be realized by providing the proper length of spring in combination with the conical-shaped funnel. The container centerline 47 is inclined from a plane that is normal to the tube axis 19 by a tilt angle 50 of about 47° to 55° depending on the tube design. This covers the usual range of tilt angles for tubes with industry designations of 13 V to 25 V. The container centerline 47 also intersects the outer surface of the funnel 15 in a plane normal to the tube axis 19 that is an axial distance 48 from the plane of the ends of the leads 33. The axial distance 48 is in the range of about 13 to 20 cm (5.1 to 7.9 inches).

As shown in FIGS. 1 and 2, the tube is assembled and the envelope has been evacuated of gases and hermetically sealed. This may be achieved by any of the known fabrication and assembly processes. However, getter material has not been vaporized from the getter container 41. In a preferred embodiment, the getter container 41 holds a mixture of nickel metal and a barium-aluminum alloy which, upon heating, reacts exothermically, vaporizes barium metal and leaves a residue of an aluminum-nickel alloy in the container 41.

To "flash" the getter; that is, to cause the exothermic reaction to take place, use is made of an induction heating coil 51 (FIG. 3) which is positioned opposite the container 41. An RF (radio frequency) power supply (not shown) is activated or permitted to be activated either manually or automatically to energize the induction coil 51. The induction coil 51, by magnetic induction, rapidly heats the getter container 41 and its contents until the contents flash, releasing barium vapor, which deposits principally on the mask and portions of the opaque coating 35 opposite the getter container 41. One suitable power supply is induction heating generator T-2.5-1-KC11-B3W marketed by Lepel Corporation, Maspeth, N.Y. 11378. This generator is designed to deliver about 2.5 kw of high-frequency energy in the range of 250 to 800 KHz through two conductors 52 to the induction heating coil 51. This generator includes a high-voltage DC power supply, a modified Hartley oscillator, a tapped tank coil and a control system. The control system is designed for manual operation or automatic operation. The conductors 52 are metal tubes which also carry cooling water through the coil 51.

Figure 4:
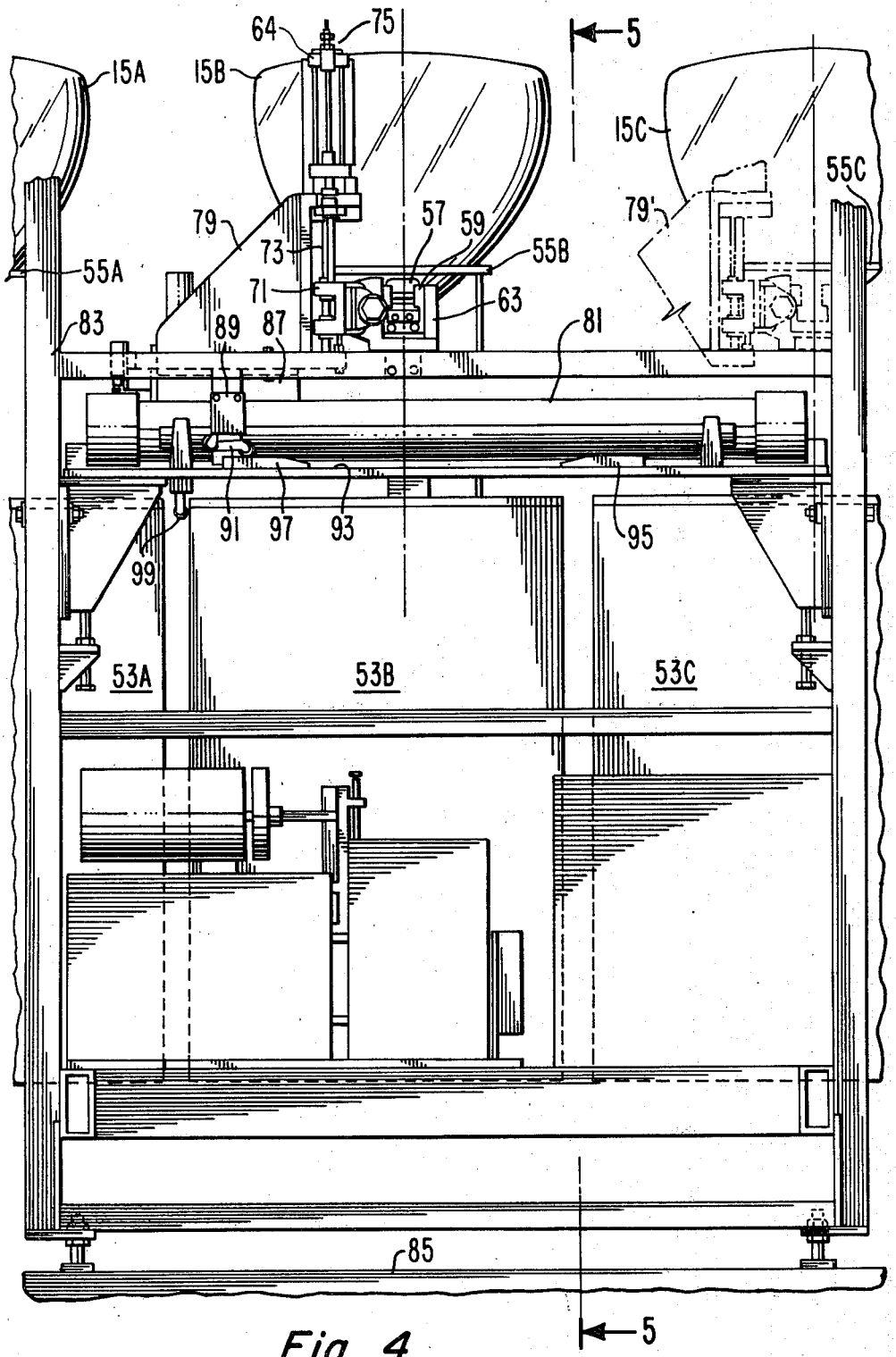
FIG. 4 is a front elevational view of an automatically-acting apparatus for practicing the novel method.
Figure 5:
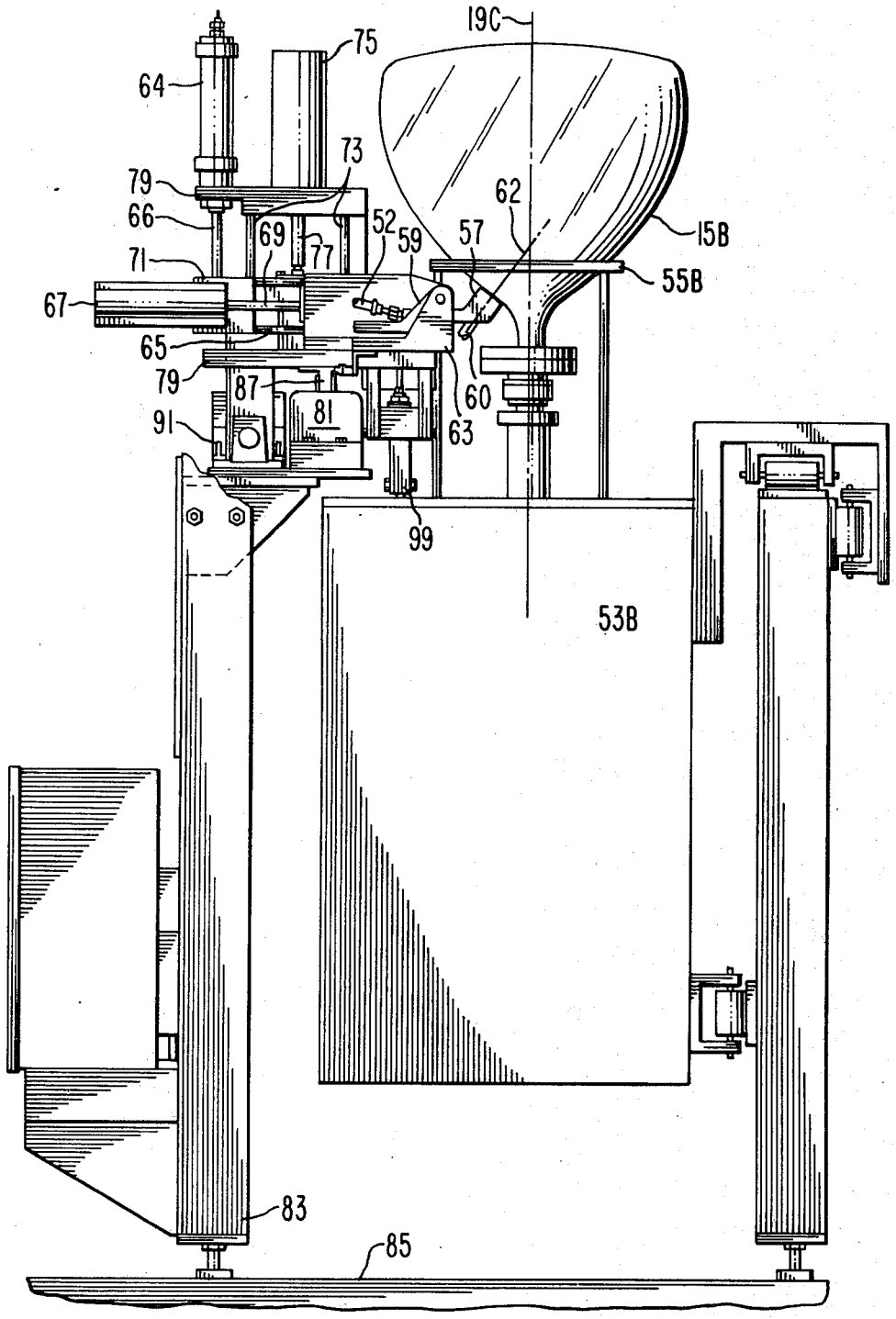
FIG. 5 is a side elevational view of the apparatus shown in FIG. 4 viewed along section line 5—5.

FIGS. 3, 4 and 5 illustrate a preferred apparatus for practicing the novel method in cooperation and coordination with an in-line exhaust machine, which comprises a multiplicity of exhaust carts 53A, 53B, 53C etc. (FIGS. 4 and 5) arranged as a train in a closed loop. Each cart is adapted to carry a single cathode-ray tube 15A, 15B and 15C respectively on holders 55A, 55B and 55C through an oven where it is baked at elevated temperatures and simultaneously exhausted of gases through a glass tubulation. At the end of the baking cycle, the glass tubulation is heated to "tip-off" the tube; that is, a portion of the glass tubulation is heated to the molten state whereby the passage through the tubulation is closed and the tube is sealed. Details of exhaust carts and their use in exhausting cathode-ray tubes have been described previously; for example, in U.S. Pat. Nos. 2,532,315 to M. E. Johnson et al., 3,115,732 to J. F. Stewart and 3,922,049 to F. S. Sawicki.

Significantly, when a tube is loaded on an exhaust cart, the longitudinal axis and the plane of minor axes of the tube are located and oriented with respect to the front, back and sides of the cart. The novel apparatus shown in FIGS. 4 and 5 takes advantage of this location and orientation by temporarily coupling a carrier for an induction coil 51 to the cart (53B as shown in FIGS. 4 and 5) at a station along the path of the cart after the tube has been tipped off and before the tube is unloaded from the exhaust cart. The novel apparatus, while coupled to the cart, moves the induction coil 51 up to the position opposite the getter container 41 as described with respect to FIG. 3. The coil 51 is moved horizontally to the distance 49 from the tube axis 19 as indicated by the first arrow A. Then, the coil 51 is moved upward and parallel to the tube axis 19 into contact with the funnel as indicated by the second arrow B. Then, with the coil centerline rotated to the proper tilt by the contact, the apparatus energizes the coil 51 to flash the getter and then retracts the coil.

The coil 51 is potted in a coil holder 57 which is clamped in a cradle 59 which is free to rock around a cradle shaft 61 except when locked in position as described below. Attached to and extending out from the coil holder 57 is a compressible ring 58, which is centered on the coil centerline 62, with a sensor tube 60 extending through the ring 58 and the holder 57. The cradle shaft 61 is supported on a horizontal carrier 63 which can be moved horizontally on horizontal guide bars 65 by a horizontal pneumatic cylinder 67 which is connected to the horizontal carrier 63 by horizontal piston rod 69. The horizontal guide bars 65 are supported on a vertical carrier 71 which can be moved vertically on vertical guide bars 73 by a vertical pneumatic cylinder 75 which is connected to the vertical carrier 71 by a vertical piston rod 77 (FIG. 5). The vertical guide bars 73 and the vertical pneumatic cylinder 75 are supported on a carriage 79, which is fixedly mounted on the transmitting member of a rodless pneumatic cylinder 81 of the type described in U.S. Pat. No. 3,820,446 to B. Granbom et al., for example, and marketed by Origa Corporation, Elmhurst, Ill. 60126. The rodless cylinder 81 is mounted on a frame 83 that is supported on a floor 85. The rodless cylinder 81 is mounted for horizontal movement of the transmitting member therein parallel to the movement of the exhaust carts. The transmitting member comprises a piston in the cylinder 81 and a mounting plate 87, which extends upwardly, to which the carriage 79 is bolted. The carriage 79 carries a cam-operated switch 89 whose extended arm 91 rides on a cam surface 93 between a start cam 95 and a stop cam 97. The carriage 79 also carries a retractable drag pin 99 adapted to engage and disengage from an exhaust cart.

As shown in FIGS. 4 and 5, the apparatus is at the end of its cycle in the stopped position with the arm 91 of the switch 89 raised by the stop cam 97. This also starts the new cycle by raising the drag pin 99 out of engagement with the cart 53B. After the drag pin 99 is raised, the rodless cylinder 81 is actuated with air to move the carriage 79 and the structures thereon towards the next cart 53C, during which travel the arm 91 rides on the cam surface 93 until it reaches the start cam 95, at which time the arm 91 is raised by the start cam. When the arm 91 is raised at the start cam 95, the rodless cylinder 81 is deactuated with the carriage and structures thereon located as indicated by the phantom structure 79'. Now, the drag pin 99 is lowered to a position between the carts 53B and 53C. Since the carts are moving forward (right to left in FIG. 4) together at constant spacing, the cart 53 moves to engage the drag pin 99 and thereafter, during the cycle, maintains the spatial relationship between the engaged cart 53C and the carriage 79.

After a short predetermined time delay, the horizontal cylinder 67 is activated to move the horizontal piston rod 69, pushing the horizontal carrier 63 towards the engaged cart (indicated by the arrow A of FIG. 3), stopping at a point where the coil centerline 47 intersects the minor axis plane at 5.08 cm (2.00 inches) from the longitudinal axis 19C of the tube 15C. With the horizontal carrier 63 in this extended position, the vertical cylinder 75 is activated to move the vertical piston rod 77 to raise the vertical carrier 71 until the compressible ring 58 touches the outer surface of the funnel 15 (indicated by the arrow B of FIG. 3). Air fed through the sensor tube 60 passes through the ring 58 and impinges on the funnel 15. As the ring 58 presses against the funnel, the cradle 59 rotates around the shaft 61 until the ring 58 seats flat against the funnel 15. The rise in back pressure in the sensor tube 60 is sensed by means (not shown). When the ring 58 is completely seated on the funnel 15, the back pressure is highest, and the vertical movement of the vertical carrier 63 is stopped. At this point, the coil 51 and the cradle 59 have been rotated so that the coil centerline 62 is substantially coincident with the centerline 47 of the getter container 41 which intersects the outer surface of the funnel 15 at 5.08 cm (2.00 inches) from the tube axis 19. To provide positive positioning without drift, a hydrocheck unit 64, including a sensing rod 66 connected to the vertical carrier 71, locks the vertical carrier 71 in the desired position. Also, the cradle 59 is locked in its inclined position on the shaft 61.

With the coil holder 57 so locked in position, the induction coil 51 is energized with radio-frequency current through the conductors 52. Usually, the coil 51 is energized for about 15 seconds, and the getter starts to flash in about 7 to 11 seconds. Where the coil centerline 62 is not substantially coincident with the container centerline 47, longer periods are required for the getter to flash, and in extreme cases, the getter will not flash. It has been found desirable to mount an infrared sensor adjacent the tube to detect whether the getter has flashed.

When the "flash" cycle is completed, the coil 51 is de-energized, the cradle 59 is unlocked and the vertical carrier 71 is unlocked. Then, the vertical carrier 71 is returned to its "down" position, and then the horizontal carrier 63 is returned to its retracted starting position.

During the steps described in the foregong paragraphs, the carriage 87 has been dragged from right to left, as viewed in FIG. 4, by the drag pin 99 which remained engaged with the cart 53C. Also, the cam arm 91 continued to ride on the cam surface 93, and it so continues until the cam arm 91 rides up on the stop cam 97 and the cycle is ready to begin again.

The following observations have been made with respect to the novel method:

A. The presence of the opaque conducting layer 35 prevents the getter container from being viewed visually from outside the tube but does not appear to interfere in any significant way with the induction heating process described above.

B. The novel method permits the induction heating coil to be positively and consistently located in an optimum position outside the tube for heating an electrically-conducting container inside the tube. This optimum positioning provides consistently better magnetic coupling between the heating coil and the getter container. Thus, less power is required for flashing the getter, the induction heating can be rapid and the total time required for the flashing cycle can be reduced.

C. Optimum positioning also results in more uniform heating of the getter container and better control over the exothermic chemical reaction which is more predictable if uniform heating is achieved. Through more uniform heating, a higher yield of vaporized getter material with the desired distribution can be achieved. Also, more uniform heating can result in reduced splashing of getter material and a reduction in the amount of loose particles in the tube, which particles may be a cause of arcing during the operation of the tube. Also, more uniform heating helps prevent burn-through of the getter container, which is believed to be due to extremely uneven heating of the getter container.

D. The getter container and the contents of the getter container may be any of the systems known in the art of gettering. For example, any of the systems described in the patents issued to Pappadis, Reash and Turnbull, cited above, may be used. It is preferred to use an alloy of constituents which react exothermically to yield a metallic getter material in vapor form. Barium metal vapor is preferred, although strontium or other metal vapor may be produced. Also, the alloy may yield, upon heating, controlled amounts of gas for the purpose of modifying the distribution and deposition of the vapor.

E. The novel method may be practiced with the apparatus shown in FIGS. 4 and 5 but modified to process two or more carts at one time; that is, during one cycle. To this end, two or more carriages with the structures thereon substantially as described may be operated in tandem.

F. The novel method is described with respect to getter containers that are mounted to springs that are attached to the electron-gun mount assembly. The getter container may, alternatively, be mounted near or on the inner surface of the envelope from any other structure; for example, the anode button 21 or the frame on which the mask is mounted.

G. The novel method may also be practiced on a stationary machine; that is, where the carriage is stationary and the tube is brought to a stationary tube holder. For this purpose, the carriage and the structure thereon as described above may be mounted on a frame without the rodless cylinder 81, the switch 89, the cams 95 and 97 and the drag pin 99. The frame may, if desired, be a wheeled cart. Such a stationary unit would include a tube holder for holding a tube in the particular stationary position relative to the carriage as described above with respect to FIGS. 4 and 5. Such a stationary unit may be located alongside an in-line exhaust machine, or elsewhere, and tubes placed and removed from the holder one at a time.

H. The TABLE compiles some of the many tube designs on which the novel method may be practiced. The tube type indicates the envelope size and shape. The three columns marked "UNMODIFIED" show the axial distance 48 in inches, the radial distance 49 in inches and the tilt angle 50 in degrees for each tube without modification. The two columns marked "MODIFIED" show the axial distance 48 in inches and the tilt angle 50 in degrees for each tube type as it was modified by making the radial distance 2.00 inches. The significant data is the range of values for the axial distances 48, the radial distance 49 and the tilt angles 50 (as indicated in FIG. 2) for these tube types. The novel method can be practiced on a succession of tubes randomly intermixed in at least these ranges of values.

TABLE

| | UNMODIFIED | | | MODIFIED | |
|---|---|---|---|---|---|
| Tube Type | Axial Distance 48 | Radial Distance 49 | Tilt Angle 50 | Axial Distance 48 | Tilt Angle 50 |
| 25V-90° Δ | 7.257 | 1.736 | 43½ | 7.509 | 48 |
| 25V-100° PI-17 | 6.460 | 1.970 | 54 | 6.480 | 54 |
| 25V-100° PI-14 | 6.362 | 1.975 | 55 | 6.376 | 55 |
| 25V-100° PI-5 | 5.144 | 2.070 | 55 | 5.094 | 55 |
| 25V-110° PI-21 | 6.498 | 2.350 | 53 | 6.222 | 51 |
| 19V-100° PI-19 | 6.442 | 1.940 | 54 | 6.482 | 54 |
| 13V-90° PI-10 | 5.709 | 1.987 | 49 | 5.720 | 49 |
| 13V-90° PI-12 | 6.479 | 2.100 | 49 | 6.406 | 48 |
| 13V-90° PI-17 | 6.840 | 2.075 | 49 | 6.764 | 47 |

I claim:

1. In a method for vaporizing getter material in a succession of cathode-ray tubes of different sizes and/or shapes, each of said tubes having a longitudinal tube axis and comprising an envelope and a getter container adjacent to the inner surface of said envelope, said getter container having a container centerline, said method including, for each tube, (i) positioning an induction coil having a coil centerline adjacent to the outer surface of said envelope opposite said getter container, (ii) and energizing the positioned induction coil so as to heat said getter container by induction and to vaporize getter material therefrom, the improvement comprising permanently fixing the getter container of each tube in said succession in such position that said container centerline intersects the outer surface of said envelope at substantially the same distance from said longitudinal tube axis as each of the other tubes in said succession.

2. The method defined in claim 1 including moving said induction coil to such position adjacent said outer surface that the coil centerline intersects said outer surface at substantially the same point as said container centerline.

3. The method defined in claim 2 wherein said induction coil is integral with a coil housing having associated sensing means, said method including moving said induction coil along a path parallel to said tube axis towards said outer surface, and stopping said coil movement in response to a signal from said sensing means upon contact with said outer surface.

4. The method defined in claim 3 wherein said sensing means includes a tube through said coil substantially centered on said coil centerline, said tube having an open end of compressible material that extends beyond said coil, said method including passing a gas through said tube and out of said open end, moving said open end towards said outer surface, and sensing a substantial change in the back pressure in said tube when said open end contacts said outer surface.

5. In a method for vaporizing getter material from each of the getter containers located inside and adjacent to the inner surfaces of the envelopes of a succession of cathode-ray tubes of different randomly-intermixed sizes, each of said tubes having a longitudinal tube axis and orthogonal planes of minor axes and major axes respectively that pass through said tube axis, and each of said containers having a container centerline, said container centerline being inclined with respect to and intersecting said tube axis, said method including, for each tube, (i) positioning an induction coil having a coil centerline adjacent to the outer surface of said envelope opposite said getter container, (ii) and energizing the positioned induction coil so as to heat said getter container by induction and to vaporize getter material therefrom, the improvement comprising permanently fixing the getter container in each one of said tubes in such position that the container centerline thereof passes through the outer surface of said envelope in the plane of minor axes at about the same distance from the tube axis, whereby in step (i) said induction coil may be positioned the same distance from said tube axis as each of the other tubes in said succession of tubes.

6. The method defined in claim 5 wherein each of said tubes includes a mount assembly, said getter container is fixedly attached to one end of an elongated spring and the other end of said spring is attached to said mount assembly, and said distance between said container centerline and said tube axis is realized by differences in the length of said spring for differently-sized tubes.

7. The method defined in claim 6 wherein each of said tubes is carried on one of a succession of carts which pass through a station along a defined path, and said induction coil is carried on a carriage in said station, said carriage being movable along a defined path parallel to the path of said carts and coordinated with the movement of said carts.

8. The method defined in claim 7 including mechanically coupling said carriage to each cart as it enters said station, then carrying out steps (i) and (ii) while said cart is moving through said station with the carriage coupled thereto, and then uncoupling said carriage from said cart as said cart leaves said station.

* * * * *